US008029729B2

(12) United States Patent
Tang et al.

(10) Patent No.: US 8,029,729 B2
(45) Date of Patent: Oct. 4, 2011

(54) ANTIGEN EXPOSURE CHAMBER SYSTEM

(75) Inventors: Huaipeng Tang, Shinjuku-ku (JP); Akihiro Seta, Shinjuku-ku (JP); Toshihiro Anai, Shinjuku-ku (JP); Toshikatsu Ueda, Shinjuku-ku (JP); Minoru Okuda, Machida (JP); Kazuhiro Hashigucci, Yokohama (JP); Kimihiro Okubo, Bunkyo-ku (JP)

(73) Assignee: Shinryo Corporation, Tokyo (JP)

( * ) Notice: Subject to any disclaimer, the term of this patent is extended or adjusted under 35 U.S.C. 154(b) by 260 days.

(21) Appl. No.: 12/088,568

(22) PCT Filed: Sep. 28, 2005

(86) PCT No.: PCT/JP2005/017865

§ 371 (c)(1),
(2), (4) Date: Mar. 28, 2008

(87) PCT Pub. No.: WO2007/037000

PCT Pub. Date: Apr. 5, 2007

(65) Prior Publication Data

US 2009/0257919 A1 Oct. 15, 2009

(51) Int. Cl.
*F24F 7/06* (2006.01)

(52) U.S. Cl. ..... 422/50; 454/237; 454/228; 600/300; 118/326; 277/634

(58) Field of Classification Search ..... None
See application file for complete search history.

(56) References Cited

U.S. PATENT DOCUMENTS

| | | | | |
|---|---|---|---|---|
| 5,010,777 | A * | 4/1991 | Yehl et al. | 73/864.81 |
| 2004/0054262 | A1 * | 3/2004 | Horak | 600/300 |

FOREIGN PATENT DOCUMENTS

| | | | |
|---|---|---|---|
| JP | 62-189711 | A | 12/1987 |
| JP | 2000-337674 | * | 8/2000 |
| JP | 2000-337674 | A | 8/2000 |
| JP | 2004-305904 | A | 4/2004 |

OTHER PUBLICATIONS

Day et al. Ann. Allergy Astham Immunol 1999; 83:83-93.*

(Continued)

*Primary Examiner* — Sally Sakelaris
(74) *Attorney, Agent, or Firm* — Browdy and Neimark, PLLC

(57) ABSTRACT

An object of the present invention is to solve the problems in conventional art antigen exposure chambers, and specifically, to provide an antigen exposure chamber system capable of simultaneously exposing a large number of test objects in a chamber to a uniform antigen (pollen, mite or house dust, etc.) in all seasons. In order to achieve the above object, in an antigen exposure chamber system according to the present invention, an outdoor air is supplied via an outdoor air diffuser 2 provided in a ceiling surface of an exposure chamber 1 into the exposure chamber from the ceiling surface of the exposure chamber in a horizontal direction, a fan unit 15, including a supply port and a suction port, is provided in each of the four corners of the exposure chamber to provide a circulating flow of air flowing with circulation in the horizontal direction in the exposure chamber, an air exhaust port 4 is provided at a floor surface of the exposure chamber to exhaust an air from the floor surface of the exposure chamber, an antigen is supplied from an antigen supply device to the outdoor air diffuser provided on the ceiling surface so that the antigen is mixed with the outdoor air, and a uniform concentration antigen exposure is enabled by the circulating flow of air.

8 Claims, 5 Drawing Sheets

OTHER PUBLICATIONS

Krug et al. Clin. Exp. Allergy 2003; 33: 1667-1674.*
N. Krug, et al. "Validation of an Environmental Exposure Unit for Controlled Human Inhalation Studies with Grass Pollen in Patients with Seasonal Allergic Rhinitis." Clin. Exp. Allergy, vol. 33, No. 12, 2003, pp. 1667-1674.
Japanese office action, partial translation, dated Jun. 22, 2010.

* cited by examiner

Figure 1
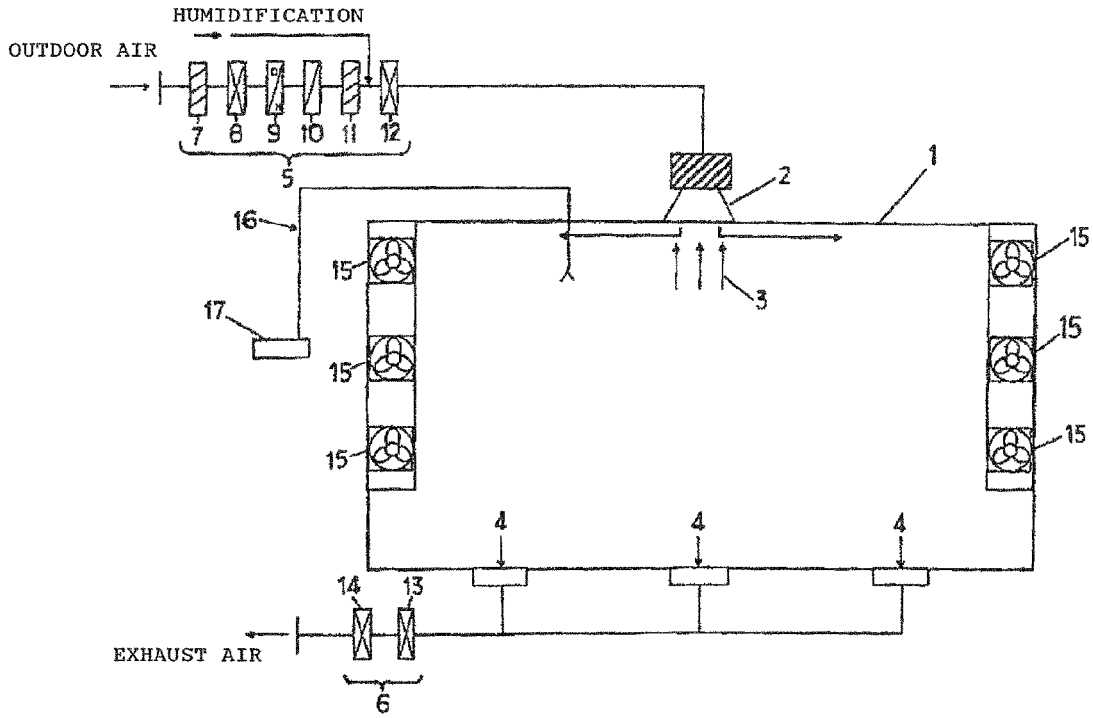
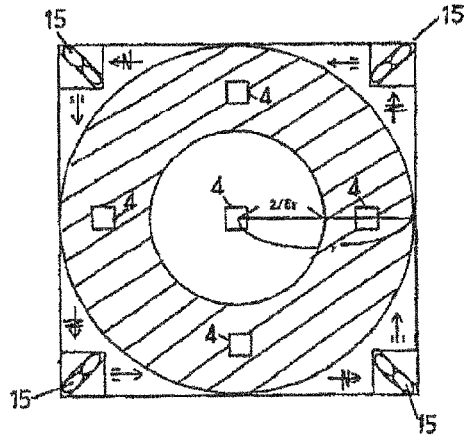

Figure 2
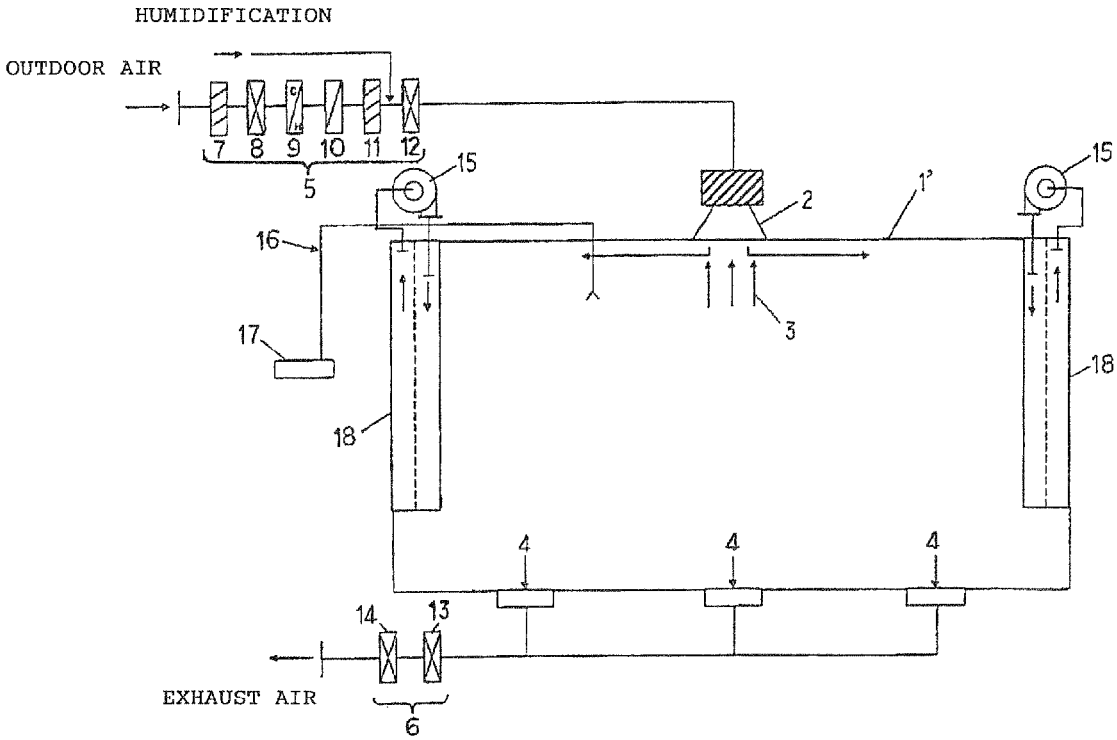
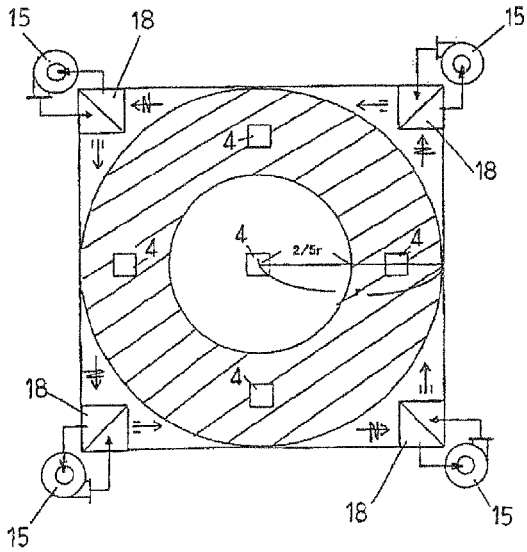

Figure 4

<MEASUREMENT CONDITIONS>

AIR FLOW SYSTEM: CEILING AIR SUPPLY + CIRCULATING AIR FLOW + UNDERFLOOR AIR EXHAUST,
CEILING AIR SUPPLY + CIRCULATING AIR FLOW + AIR EXHAUST FROM ONE
CENTRAL POINT AND FOUR POINTS ON CONCENTRIC CIRCLE

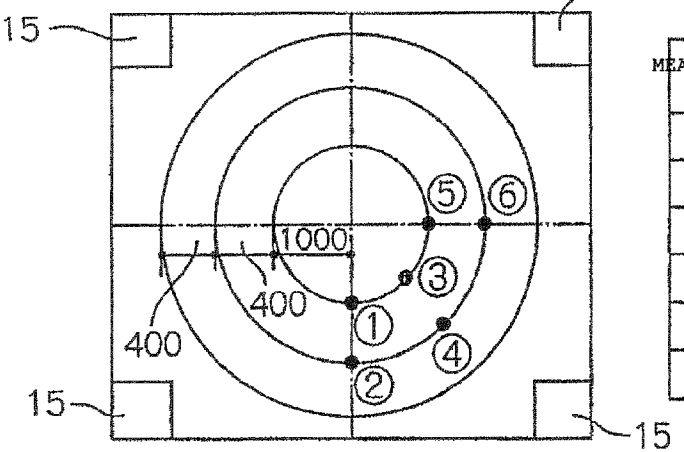

OCCUPIED SPACE AIR FLOW VELOCITY
MEASUREMENT POINT ARRANGEMENT

RESULTS OF OCCUPIED SPACE AIR FLOW VELOCITY
DISTRIBUTION MEASUREMENTS (m/s)

| MEASUREMENT POINT | FL+1,000 | FL+1,150 | FL+1,300 |
|---|---|---|---|
| ① | 0.29 | 0.31 | 0.30 |
| ② | 0.35 | 0.38 | 0.42 |
| ③ | 0.33 | 0.27 | 0.33 |
| ④ | 0.41 | 0.37 | 0.35 |
| ⑤ | 0.22 | 0.24 | 0.28 |
| ⑥ | 0.36 | 0.37 | 0.37 |

TUBE MATERIAL TYPE
Differences in Measurement Results according to Tube Materials PVC: vinyl chloride, PTFE: teflon, PP: polypropylene, PE: polyethylene
PVC1 to PVC4 are vinyl chloride tubes made by four manufacturers, and are different from each other in plasticizer used

ANTIGEN EXPOSURE CHAMBER SYSTEM

TECHNICAL FIELD

The present invention relates to an antigen exposure chamber system for exposing subjects to an antigen.

BACKGROUND ART

Antigen exposure chamber systems configured so as to supply a predetermined amount of antigen to expose a subject to the antigen have been used for experiments and researches relating to diseases such as allergy.

Conventional antigen exposure chamber systems include ones provided with a ceiling air supply port and a ceiling air exhaust port at the ceiling of the chamber, or an air supply port at the ceiling of the chamber and an air exhaust port at the lower portion of the chamber walls, thereby generating an air flow flowing between the air supply port and the air exhaust port and mixing an antigen supplied from the outside of the chamber into this air flow. However, each of them has an extremely non-uniform antigen concentration distribution in the chamber (for example, see Non-Patent Document 1).

Furthermore, there are no measures to prevent an antigen from flowing out of the chamber more than making the chamber pressure to be a negative pressure, which is extremely insufficient for preventing an antigen from flowing out of the chamber, so there has been the possibility that an antigen flows to the outside of the antigen exposure chamber.

Also, when a measuring device is installed outside the exposure chamber, a sampling tube is used to take sample antigen concentrations in the chamber. However, there are various kinds of materials for sampling tubes for the conventional antigen exposure chamber systems, and there are no fixed arrangement routes for such sampling tubes, and compensation of the measured values has not been made. Accordingly, there is a problem in that the loss of antigen particles is so large that an accurate concentration measurement cannot be conducted, depending on the material, the length or the bent portion count of the tube.

Patent Document 1: None

Non-Patent Document 1: N. Krug et al., Validation of an environmental exposure unit for controlled human inhalation studies with grass pollen in patients seasonal allergic rhinitis, Clinical & Experimental Allergy, Vol. 33, No. 12, p.p. 1667-1674, December 2003

DISCLOSURE OF THE INVENTION

Problem to be Solved by the Invention

An object of the present invention is to solve the problems in the aforementioned conventional art antigen exposure chambers, and more specifically to provide an antigen exposure chamber system capable of simultaneously exposing a large number of subjects in a chamber to a uniform antigen (pollen, mite or house dust, etc.) in all seasons.

Means for Solving the Problem

In order to achieve the above object, in an antigen exposure chamber system according to the present invention, an outdoor air is supplied via an outdoor air diffuser provided in a ceiling surface of an exposure chamber into the exposure chamber from the ceiling surface of the exposure chamber in a horizontal direction, a fan unit, including a supply port and a suction port, is provided in each of the four corners of the exposure chamber to provide a circulating flow of air flowing with circulation in the horizontal direction in the exposure chamber, an air exhaust port is provided in a floor surface of the exposure chamber to exhaust an air from the floor surface of the exposure chamber, an antigen is supplied from an antigen supply device to the outdoor air diffuser provided in the ceiling surface so that the antigen is mixed with the outdoor air, and a uniform concentration antigen exposure is enabled by the circulating flow of air.

The antigen exposure chamber system according to the present invention further comprises an antigen concentration measuring device for measuring an antigen concentration within the antigen exposure chamber. When the antigen concentration measuring device is installed outside the chamber, it is preferable to take a sample air within the chamber by means of the sampling tube, and to minimize a measurement error caused by the sampling tube by using PVC (polyvinyl chloride) as the material for the sampling tube and providing a fixed arrangement route for the sampling tube.

The antigen exposure chamber system according to the present invention further comprises a guard room surrounding the antigen exposure chamber, wherein a chamber pressure within the antigen exposure chamber is made to be a negative pressure, or the chamber pressure is made to be a positive pressure and the guard room is made to have a negative pressure, and an air shower is provided at an entrance/exit, thereby preventing the antigen from leaking out of the chamber.

It is preferable that the air flow rate and velocity of the introduced outdoor air and the circulating air flow are controlled so that subjects do not feel draft (ventilation).

Furthermore, it is preferable that an outdoor air introduction system is provided with means for adjusting a temperature and humidity of the introduced outdoor air to provide a set temperature and humidity within the antigen exposure chamber, and a filter for removing a particulate substance, and an activated carbon filter for removing a gaseous contaminant ($NO_x$, $SO_x$, VOC or aldehydes, etc.)

It is preferable that the air exhaust system is also provided to a filter for removing the antigen in the exhaust air.

Effects of the Invention

As a result of employing the above configuration, the antigen exposure chamber system according to the present invention is capable of uniformizing the antigen concentrations in the chamber with a variation of around ±10%.

Furthermore, it is capable of minimizing the flow of the antigen in the chamber to the outside, and also capable of accurately measuring an antigen concentration within the chamber.

BRIEF DESCRIPTION OF THE DRAWINGS

FIG. 1 shows a side view and plain view of a schematic configuration of an embodiment of an antigen exposure chamber system according to the present invention;

FIG. 2 shows a side view and plain view of a schematic configuration of another embodiment of an antigen exposure chamber system according to the present invention;

FIG. 4 is a diagram indicating the measurement results of an air flow velocity distribution in the chamber according to the embodiment shown in FIG. 1.

DESCRIPTION OF SYMBOLS

Figure 3:
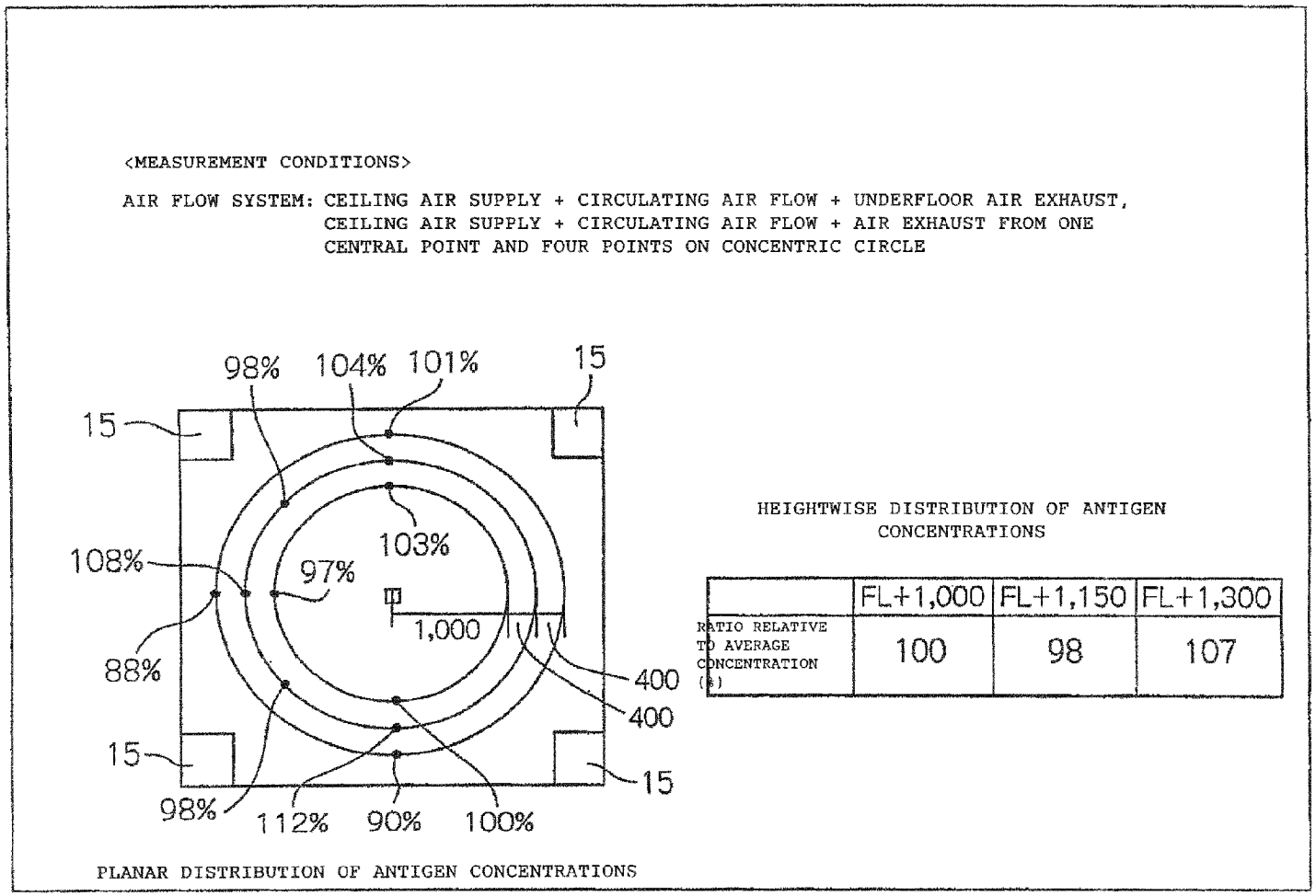
FIG. 3 is a diagram indicating the measurement results of an antigen concentration distribution in the chamber according to the embodiment shown in FIG. 1.
Figure 5:
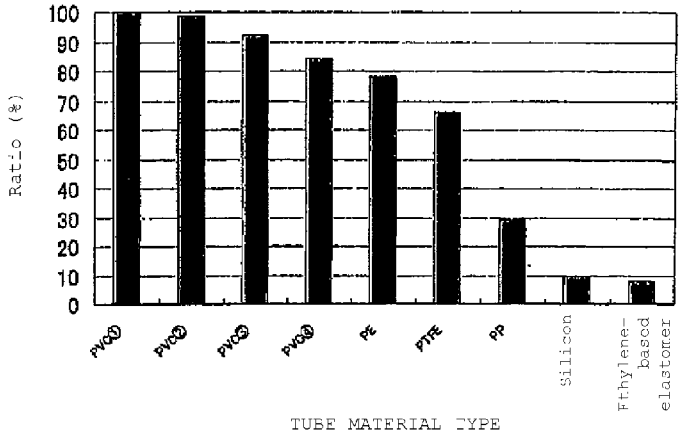
FIG. 5 is a chart showing the differences in measurement results according to the type of tube material.

1, 1': antigen exposure chamber,
2: outdoor air diffuser, 3: antigen,
4: air exhaust port, 5: supply air filter unit,
6: exhaust air filter unit, 7: pre-air filter,
8: medium-efficiency air filter,
9: cold/hot water coil, 10: pre-heater,
11: activated carbon filter, 12: HEPA filter,
13: medium-efficiency air filter, 14: HEPA filter,
15,15': fan unit, 16: sampling tube,
17: antigen concentration measuring device,
18: circulating air flow duct

BEST MODE FOR CARRYING OUT THE INVENTION

FIG. 1 shows a side view and plain view of a schematic configuration of an embodiment of an antigen exposure chamber system according to the present invention. Generally, an antigen exposure chamber 1 is configured so as to blow a certain high concentration antigen 3, such as pollen, mite or house dust, etc., supplied from an antigen supply device (not shown) into an outdoor air supplied from an outdoor air diffuser 2 provided at the center of its ceiling to mix them, and to make the air containing the thus mixed antigen permeate the chamber, and to exhaust the air from air exhaust ports 4 provided at the floor surface of the antigen exposure chamber.

The outdoor air to be supplied to the outdoor air diffuser 2 is supplied via a supply air filter unit 5. The supply air filter unit 5 includes a pre-air filter 7, a medium-efficiency air filter 8, a cold/hot water coil 9, a pre-heater 10, an activated carbon filter 11 and a HEPA (high-efficiency particulate air) filter 12.

Meanwhile, the exhaust air from the air exhaust ports 4 is discharged via an exhaust air filter unit 6. The exhaust air filter unit 6 includes a medium-efficiency air filter 13 and a HEPA filter 14.

As shown in the FIG. 1 plain view, the air exhaust ports 4 are provided at one central point of the chamber and at four points on a concentric circle with a diameter of ⅔r to 1r where r is the radius of an inscribed circle of the chamber with the aforementioned central point as its center.

As shown in the Figure, a total of twelve fan units 15 are provided at the four corners of the antigen exposure chamber 1. Each fan unit 15 is provided with an air suction port and an air supply port. Accordingly, as can be seen from the plain view in the lower portion of FIG. 1, the suction and supply of air in the fan units 15 generates a circulating flow of air circulating in a counterclockwise direction in FIG. 1. This circulating air flow makes the air flow containing the antigen uniformly permeate the entire antigen exposure chamber. The velocity of the circulating air flow is controlled to a level that subjects in the chamber do not feel draft.

Although it is preferable that an antigen concentration within the antigen exposure chamber is directly measured by placing an antigen concentration measuring device 17 within the antigen exposure chamber 1, in the present embodiment, it is measured by the antigen concentration measuring device 17 via a sampling tube 16. The antigen concentration measuring device 17 controls the antigen supply device based on the measured antigen concentration so as to constantly provide a predetermined antigen concentration. A measurement error caused by the sampling tube is minimized by using PVC (polyvinyl chloride) as a material for the sampling tube and providing a fixed arrangement route for the sampling tube.

With the aforementioned configuration, the antigen exposure chamber 1 has an atmosphere with an extremely-uniform antigen concentration distribution, enabling exposing a plurality of subjects to an antigen at the same time. In the antigen exposure chamber, the chamber pressure is made to be a negative pressure, or the chamber pressure is made to be a positive pressure and a guard room is made to have a negative pressure, and furthermore, an air shower (not shown) is provided at an entrance/exit of the chamber, preventing the antigen from leaking out of the chamber.

Although in the present embodiment, the antigen is supplied toward the outdoor air diffuser 2 from the inside of the chamber, it may be supplied at a position above the outdoor air diffuser 2 outside the chamber.

FIG. 2 shows a side view and plain view of a schematic configuration of another embodiment of an antigen exposure chamber system according to the present invention. The present embodiment is configured so that fan units are installed outside the chamber. As can be seen from the Figure, one fan unit 15' is provided at each of the upper external four corners of the antigen exposure chamber 1' as shown in the FIG. 2 plain side view. Furthermore, at each of the internal four corners of the antigen exposure chamber 1', a circulating air flow duct 18 that guides the air flow caused by the fan unit is provided. The circulating air flow duct 18, as shown in the side view, generates an air flow going from the lower portion to the upper portion within the circulating air flow duct 18, going through the fan and then going from the upper portion to the lower portion as a result of rotation of the fan unit 15', and as shown in the plain view, it is provided with openings so as to generate an air flow circulating in a counterclockwise direction, which goes through the circulating flow duct in a horizontal direction. With such configuration, when the fan units are activated, the flow of air containing the antigen uniformly permeates the entire antigen exposure chamber, forming an exposure space with a predetermined antigen concentration distribution. The velocity of the circulating air flow is controlled to a level that subjects within the chamber do not feel draft, as in the preceding embodiment.

The other components of the antigen exposure chamber 1' are similar to those in the antigen exposure chamber system shown in FIG. 1, and accordingly, are provided with the same reference numerals as those in FIG. 1. Since the functions of these components are also the same as those in FIG. 1, the description thereof is omitted.

FIGS. 3 and 4 are diagrams indicating the measurement results of an antigen concentration distribution in the chamber and the measurement results of an air flow velocity distribution in the chamber according to the embodiment shown in FIG. 1, respectively. The results exhibit a variation of substantially within ±10%, indicating that the results are remarkably favorable compared to the conventional antigen exposure chamber systems.

Furthermore, FIG. 1 is a chart indicating differences in measured concentration value according to the materials for the sampling tube 16, where the ratio r satisfies the following formula:

$$\text{Ratio } r = \frac{\text{Measurement value when the tube is used}}{\text{Measurement value when the tube is not used}} \times 100\ (\%)$$

Table 1 is a chart indicating differences and variations in measurement results according to the sampling tube lengths and the lapse times.

TABLE 1

| Effect of the Length of the Sampling Tube (PVC) (Ratio r) | | | | |
|---|---|---|---|---|
| | Lapse Time | | | |
| Tube Length | 2 h | 4 h | 6 h | 8 h |
| 6 m | 94 | 94 | 94 | 93 |
| 10 m | 79 | 81 | 81 | 83 |

$$\text{Ratio } r = \frac{\text{Measurement value when the tube is used}}{\text{Measurement value when the tube is not used}} \times 100\,(\%)$$

These charts show that it is preferable to use vinyl chloride for the sampling tube material because it has only a small effect on the concentration measurement results. Also, they show that it is preferable to use a shorter tube because it has a smaller effect on the concentration measurement results.

INDUSTRIAL APPLICABILITY

Although the antigen exposure chamber system according to the present invention has been described above with reference to embodiments thereof, the present invention is not limited to these embodiments, and various alterations and modifications can be made within the technical idea of the present invention.

The invention claimed is:

1. An antigen exposure chamber system for exposing a subject to an antigen, the system comprising:

an antigen exposure chamber having a ceiling, a floor, and four corners, said antigen exposure chamber having a square horizontal cross section and a center vertical axis passing through the center of the antigen exposure chamber;

only a single outdoor air inlet diffuser provided in a ceiling surface at the center vertical axis of the antigen exposure chamber so as to supply outdoor air out from the outdoor air diffuser in the ceiling surface into the antigen exposure chamber, the air diffuser being configured to diffuse outdoor air in a horizontal direction within the antigen exposure chamber;

a fan unit provided at each of the four corners of the antigen exposure chamber, each fan unit having a supply port and a suction port and providing a circulating flow of air flowing with circulation in the horizontal direction within the antigen exposure chamber, the circulating flow of air being controlled to a level that the subject does not feel a draft of blown air; and five air exhaust outlet ports positioned along the floor of the antigen exposure chamber to carry air from the antigen exposure chamber to outside of the chamber, one of which is provided at a central point of the floor along the central vertical axis of the antigen exposure chamber below the air inlet diffuser, and four others of the air exhaust outlet ports being symmetrically provided at points on a concentric circle with a diameter of ⅖r to r, where r is a radius of the inscribed circle of the chamber with the center vertical axis as its center, so as to exhaust air from the floor surface of the antigen exposure chamber, wherein the antigen is supplied from an antigen supply device so as to mix the antigen with the outdoor air by blowing the antigen into the outdoor air supplied from the outdoor air inlet diffuser provided in the ceiling surface into the antigen exposure chamber, and a uniform concentration antigen exposure is enabled by the circulating flow of air;

wherein each of the outdoor air diffuser, the air exhaust ports, the fan units and the antigen supply device is symmetrically positioned horizontally in fore-and-aft and right-and-left directions about the center vertical axis passing through the center of the antigen exposure chamber.

2. The antigen exposure chamber system according to claim 1, further comprising a sampling port for measuring an antigen concentration within the antigen exposure chamber, wherein a sample air is guided to an antigen concentration measuring device installed outside the antigen exposure chamber, via a tube formed of polyvinyl chloride (PVC).

3. The antigen exposure chamber system according to claim 1, further comprising a guard room surrounding the antigen exposure chamber, wherein a chamber pressure within the antigen exposure chamber is made to be a negative pressure, or the chamber pressure is made to be a positive pressure and the guard room is made to have a negative pressure.

4. The antigen exposure chamber system according to claim 1, wherein a system for introducing the outdoor air into the antigen exposure chamber is connected to a supply air handling unit including means for adjusting a temperature and humidity of the introduced outdoor air, a filter for removing a particulate substance, and an activated carbon filter for removing a gaseous contaminant, and the air exhaust port is connected to an exhaust air filter unit including a HEPA filter for removing the antigen in the exhaust air.

5. The antigen exposure chamber system according to claim 4, wherein the gaseous contaminant includes NOx, SOx, VOC or aldehydes.

6. An antigen exposure chamber system for exposing a subject to an antigen, the system comprising:

an antigen exposure chamber having a ceiling, a floor, four corners, and a center vertical axis passing through the center of the antigen exposure chamber;

an outdoor air inlet diffuser provided in a ceiling surface at the center vertical axis of the antigen exposure chamber positioned so as to supply outdoor air through the outdoor air diffuser in the ceiling surface into the antigen exposure chamber, the air diffuser being configured to diffuse outdoor air in a horizontal direction within the antigen exposure chamber;

means for circulating air in the chamber at a level wherein a person within the antigen exposure chamber does not feel a draft of blown air, said means comprising a fan unit provided at each of the four corners of the antigen exposure chamber, each fan unit having a supply port and a suction port and providing a circulating flow of air flowing with circulation in the horizontal direction within the antigen exposure chamber, the fan units being symmetrically positioned horizontally in a fore-and-aft and a right-and-left direction about the vertical axis passing through the center point of the antigen exposure chamber; and five air exhaust outlet ports positioned along the floor of the antigen exposure chamber, one of which is provided at a central point of the floor along the central vertical axis of the antigen exposure chamber below the air inlet diffuser, and four others of the air exhaust outlet ports being symmetrically provided at points on a concentric circle with a diameter of ⅖r to r, where r is a radius of the inscribed circle of the chamber with the center vertical axis as its center, so as to exhaust air from the floor surface of the antigen exposure chamber, and an antigen supply device for supplying the antigen by blowing the antigen into the outdoor air supplied from the outdoor air inlet diffuser, the antigen supply device being positioned so as to mix the antigen with the outdoor air near the ceiling surface in the antigen exposure chamber, wherein a uniform concentration antigen exposure is enabled by the circulating flow of air.

7. The antigen exposure chamber system of claim 6 wherein the antigen exposure chamber has a square horizontal cross section.

8. The antigen exposure chamber system of claim 6 comprising only one said outdoor air inlet diffuser.

* * * * *